US006751807B2

(12) United States Patent
Klotz et al.

(10) Patent No.: US 6,751,807 B2
(45) Date of Patent: Jun. 22, 2004

(54) PIEZO FAN FOR VENTILATED GARMENT

(75) Inventors: Conrad Lee Klotz, Nappanee, IN (US); Christian H. Clupper, Columbia City, IN (US); Rudy Diaz, Goshen, IN (US)

(73) Assignee: DePuy Orthopaedics, Inc., Warsaw, IN (US)

( * ) Notice: Subject to any disclaimer, the term of this patent is extended or adjusted under 35 U.S.C. 154(b) by 0 days.

(21) Appl. No.: 10/106,732

(22) Filed: Mar. 26, 2002

(65) Prior Publication Data

US 2003/0182711 A1 Oct. 2, 2003

(51) Int. Cl.[7] ..... A42C 5/04
(52) U.S. Cl. ..... 2/171.3
(58) Field of Search ..... 2/171.3, 410, 84, 2/202, 206, 901; 128/201.25, 201.29, 204.18

(56) References Cited

U.S. PATENT DOCUMENTS

| | | | | | |
|---|---|---|---|---|---|
| 4,498,851 | A | | 2/1985 | Kolm et al. | |
| 4,512,933 | A | * | 4/1985 | Harden | 261/30 |
| 4,554,683 | A | | 11/1985 | Wong | |
| 4,780,062 | A | * | 10/1988 | Yamada et al. | 417/410.2 |
| 4,834,619 | A | * | 5/1989 | Walton | 417/53 |
| 5,008,582 | A | | 4/1991 | Tanuma et al. | |
| 5,104,430 | A | * | 4/1992 | Her-Mou | 55/385.1 |
| 5,123,114 | A | * | 6/1992 | Desanti | 2/8 |
| 5,256,159 | A | * | 10/1993 | Newman | 604/317 |
| 5,283,914 | A | * | 2/1994 | James | 2/424 |
| 5,565,148 | A | * | 10/1996 | Pendergrass, Jr. | 261/30 |
| 5,577,495 | A | * | 11/1996 | Murphy | 128/201.24 |
| 5,592,936 | A | * | 1/1997 | Thomas et al. | 128/206.12 |
| 5,814,135 | A | * | 9/1998 | Weinberg | 96/58 |
| 5,861,703 | A | | 1/1999 | Losinski | |
| 5,887,281 | A | * | 3/1999 | Green et al. | 2/171.3 |
| 5,918,593 | A | | 7/1999 | Löser | |
| 6,134,716 | A | | 10/2000 | Richardson | |
| 6,393,617 | B1 | * | 5/2002 | Paris et al. | 2/171.3 |
| 6,481,019 | B2 | * | 11/2002 | Diaz et al. | 2/171.3 |

FOREIGN PATENT DOCUMENTS

| | | | | |
|---|---|---|---|---|
| GB | 2248173 A | * | 4/1992 | A62B/17/00 |
| JP | 2000110796 A | * | 4/2000 | F04D/33/00 |
| JP | 20022339900 A | * | 11/2002 | F04D/33/00 |
| JP | 2002364599 A | * | 12/2002 | F04D/31/00 |

* cited by examiner

*Primary Examiner*—Rodney M. Lindsey
(74) *Attorney, Agent, or Firm*—Maginot, Moore & Beck

(57) ABSTRACT

A ventilated garment includes a head cover and a ventilation system associated with the head cover. The ventilation system can include a helmet supported by the wearer of the garment and a number of piezo fan assemblies mounted on the helmet. The piezo fan assemblies includes a number of piezo blades that generate airflow from piezo-induced oscillation of the blades. In certain embodiments, the piezo fan assemblies can include multiple outlet ducts to provide directed airflow in multiple directions.

18 Claims, 5 Drawing Sheets

PIEZO FAN FOR VENTILATED GARMENT

BACKGROUND OF THE INVENTION

The present invention relates generally to protective garments, and particularly to garments incorporating a personal portable ventilation system. The invention has particular application for protective garments that include a head cover providing an air-tight space around the head of the wearer.

Ventilated protective garments are used in many applications. One common usage is in the field of surgery. Surgical gowns have long been used to cover and protect a surgeon and associated medical personnel in an operating room. The typical surgical gown is formed from non-woven fabrics and is generally in the nature of an overcoat protecting or covering the medical personnel from the neck down. In order to help maintain a sterile environment, the medical personnel also wear a breathing mask over the mouth and nose. The breathing mask is constructed in a manner to filter inhaled and exhaled air from the medical personnel.

As the art of surgery has developed, the requirements for maintaining a sterile environment in the operating room has increased. In addition, a new demand has arisen for protecting the medical personnel. One specific motivation for this need has been the advent of diseases, such as AIDS, which can be communicated by exposure to bodily fluids. Accordingly, surgical gowns have been developed that include head sections that cover the face and head of the medical personnel. The contemporary operating room attendant is covered virtually from head to foot which helps to reduce the risk of contamination of the surgical environment and patient, as well as contamination of the person within the protective garment.

Of course, once the head of the medical personnel is covered, ventilation becomes an issue. A variety of personnel air supply and filtration systems have been devised for use with protective garments, such as surgical gowns. In some instances, a mouthpiece and air supply, akin to underwater diving apparatus, have been implemented. In other systems, a helmet or headpiece is worn by the medical personnel in which the helmet carries the ventilation components. In one typical installation, the ventilation component is a fan and a series of ducts that direct air flow to the mouth and nose of the medical personnel.

One problem associated with most ventilation systems is that they are heavy and bulky. The weight of a typical ventilation fan system can become uncomfortable for the person wearing the protective garment, regardless of how the ventilation fan system is supported. The weight becomes even more problematic for ventilation systems incorporated into or supported by a helmet worn by the person. The weight of the ventilation system is a common source of neck fatigue. Moreover, the weight poses an inertia or balance problem as the person moves his/her head.

A further problem associated with the known ventilation systems is that the systems are noisy. This noise problem is particularly compounded when a helmet-mounted ventilation fan, for instance, is situated near the ears of the wearer. The typical fan-based ventilation system also experiences heat build-up due to friction in the moving components of the system.

Consequently, there remains a need for a more optimum ventilation system for use with protective garments. The ventilation system should be lighter weight and less noisy than prior ventilation systems. While improvements in these two areas are significant, an optimum ventilation system would also operate more efficiently and provide better air flow than prior known ventilation systems.

SUMMARY OF INVENTION

In view of the shortcoming of prior ventilation systems, the present invention contemplates a ventilation system that comprises piezo fan elements. Thus, one embodiment of the invention provides a ventilated garment comprising a head cover defining an airspace for receiving the head of a wearer therein, an air-moving system including a piezo fan assembly including a number of piezo elements, each having an oscillating blade operable to generate airflow, and means for supporting said piezo fan assembly within said airspace. In one embodiment, the means for supporting includes a helmet to be worn on the head of the wearer. In another embodiment, the means for supporting said piezo fan assembly includes at least one piezo element carried by the head cover.

In accordance with one feature of the invention, each piezo fan assembly includes a plurality of piezo elements. The plurality of piezo elements can be supported within a common housing. In certain embodiments, a first number of the plurality of piezo elements are oriented within the housing to generate airflow in a first direction, while a second number of the piezo elements is oriented to generate airflow in a second direction different from the first direction. In addition, another feature of the invention allows the first number of piezo elements to be different from the second number so that different airflow rates can be realized at different outlets.

In one feature of certain embodiments, the piezo fan assembly includes a housing defining a common inlet opening and multiple outlet ducts. The outlet ducts can be arranged so that discharge airflow is generally perpendicular to the inlet airflow through the inlet opening. In one aspect of the invention, the piezo elements can be arranged within the housing so that they are disposed within a corresponding duct. Moreover, the piezo elements can be arranged so that their respective inlet ends are aligned with the inlet opening.

In some embodiments, the piezo fan assembly includes a power supply, which may be part of the assembly or may be independent of the garment. The power supply can include a battery carried by the same means for supporting the fan assembly. Alternatively, the fan assembly can be electrically connected to an external power supply, such as a battery pack that is worn on the torso of the person.

In a further aspect of the invention, a ventilated garment is provided that comprises a head cover defining an airspace for receiving the head of a wearer therein, a ventilation component having a housing defining an air inlet and at least two air outlets and an air-moving member disposed between said inlet and said outlets, and means for supporting the ventilation component within said airspace. One feature of this aspect of the invention is that airflow in multiple directions can be achieved from a common air-moving member. In the preferred embodiments, the air-moving member includes at least one piezo fan component. Preferably, an air-moving member can be associated with each of the at least two air outlets. In certain embodiments, a first number of piezo fan components can be associated with one of the air outlets, and a second number of piezo fan components can be associated with another of the air outlets.

One object of the invention is to provide a lightweight air-moving component that is particularly well-suited for use in a personal ventilation system. One benefit afforded by the present invention is that the air-moving component is not only lightweight, it is also quiet in operation.

A further benefit is that the invention allows for greater flexibility in achieving directed air flow within a garment, such as a protective garment. Other objects and benefits of the invention can be discerned from the following written description and accompanying figures.

DESCRIPTION OF THE PREFERRED EMBODIMENTS

Figure 2:
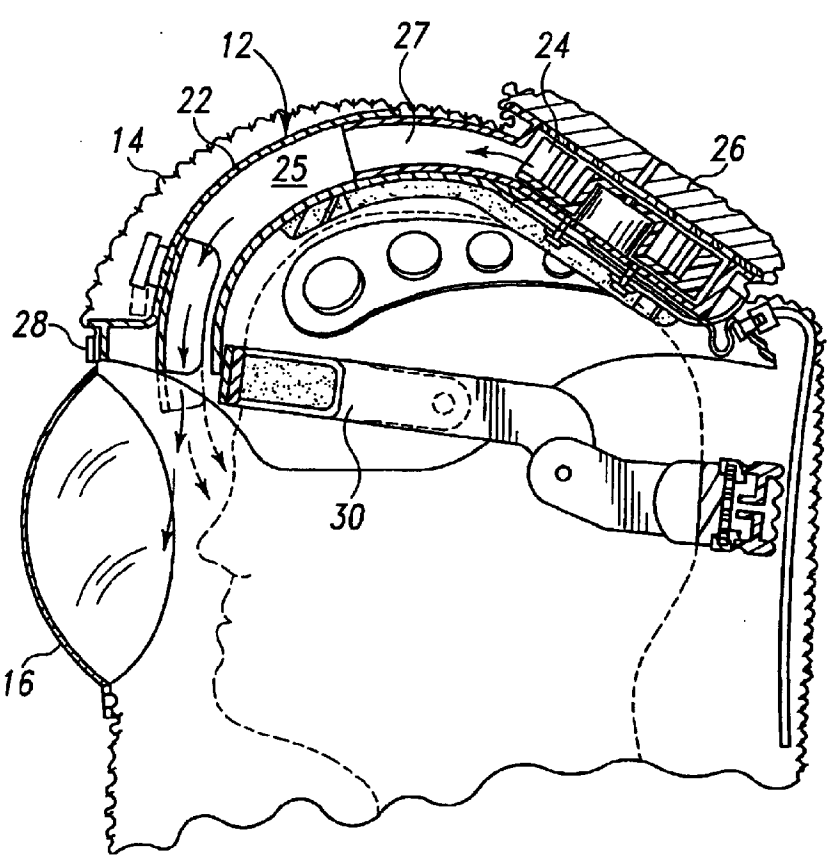
FIG. 2 is a side partial cross-sectional view of the head cover portion of the garment shown in FIG. 1, particularly illustrating one type of ventilation apparatus that can be used with the head covering of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

The present invention contemplates a ventilation system that incorporates piezo fan elements. In particular, the piezo fan elements include piezo components that vibrate or oscillate in response to an electrical or mechanical excitation. The piezo fan elements can include a number of individual piezo elements to generate a pre-determined air flow. Moreover, the piezo fan elements can include piezo components mounted within a common housing and oriented in different directions to produce airflow in different directions from the common housing. The piezo fan elements are lightweight and quiet in operation so that they can be placed virtually anywhere within a protective garment system.

Figure 1:
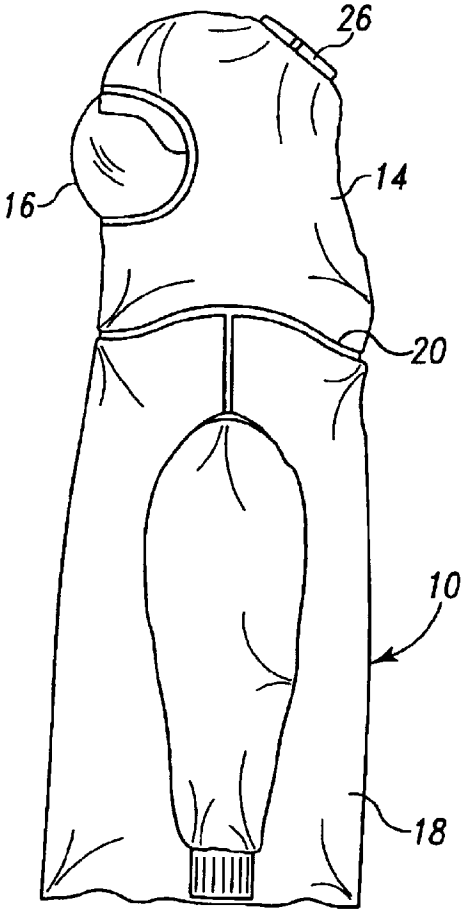
FIG. 1 is a side elevational view of one type of body-covering protective garment that can be used in combination with the present invention.

The piezo fan system of the present invention can be configured for use with a surgical gown or protective garment 10, such as that illustrated in FIG. 1. This garment 10 includes a fabric hood 14 that fits over the head of the wearer. The hood includes a face shield 16 to provide a viewing area for the medical personnel. The garment also includes a gown portion 18 that covers at least a portion of the torso of the wearer, and preferably the entirety of the person's body except the head. The fabric hood 14 can be attached to the gown 18 at a seam 20 to cover the wearer's head.

The protective garment 10 shown in FIG. 1 also includes an air moving apparatus in the form of a ventilation helmet 12, as depicted generally in FIG. 2. The helmet 12 includes a shell 22 that is preferably formed of a plastic material and that is configured to be worn on the head of the person. The shell carries a fan assembly 24 that draws exterior air through a filter 26 into the interior of the hood 14. In the ventilation helmet 12 depicted in FIG. 2, the fan assembly 24 directs air through an airflow channel 25 across the face of the wearer to provide breathable air and to help eliminate any fogging of the viewing window or face shield 16.

As shown in FIG. 2, the face shield 16 is carried by the helmet 12 by way of a face shield support 28. A strap assembly 30 helps maintain the helmet in position on the head of the wearer and helps the wearer account for the weight and inertia of the components of the helmet.

In this garment 10, the filter 26 is supported by the fan assembly 24. The fabric hood 14 is configured to sealing engage the fan assembly and/or filter 26. The orientation of the fan assembly 24 relative to the head of the wearer can be adjusted by an adjustable conduit 27 that slides to variable positions within the airflow channel 25. Thus, the fan 24 can be shifted to a position that is comfortable to the wearer.

The protective garment 10 and the ventilation helmet 12 described with respect to FIGS. 1 and 2 are the subject of a co-pending PCT application International Publication No. WO 99/35927, filed on Jan. 15, 1999 and based on U.S. Provisional application Ser. No. 60/071,753, filed on Jan. 16, 1998. The description of the garment and the ventilation helmet in this co-pending PCT application is incorporated herein by reference. In the preferred embodiment of the present invention, the inflatable hood is adapted for use with this garment 10 and ventilation helmet 12. However, it is contemplated that the invention can be used with a variety of protective garments, garment configurations, and gowns, as well as with a wide range of ventilation systems.

Figure 3:
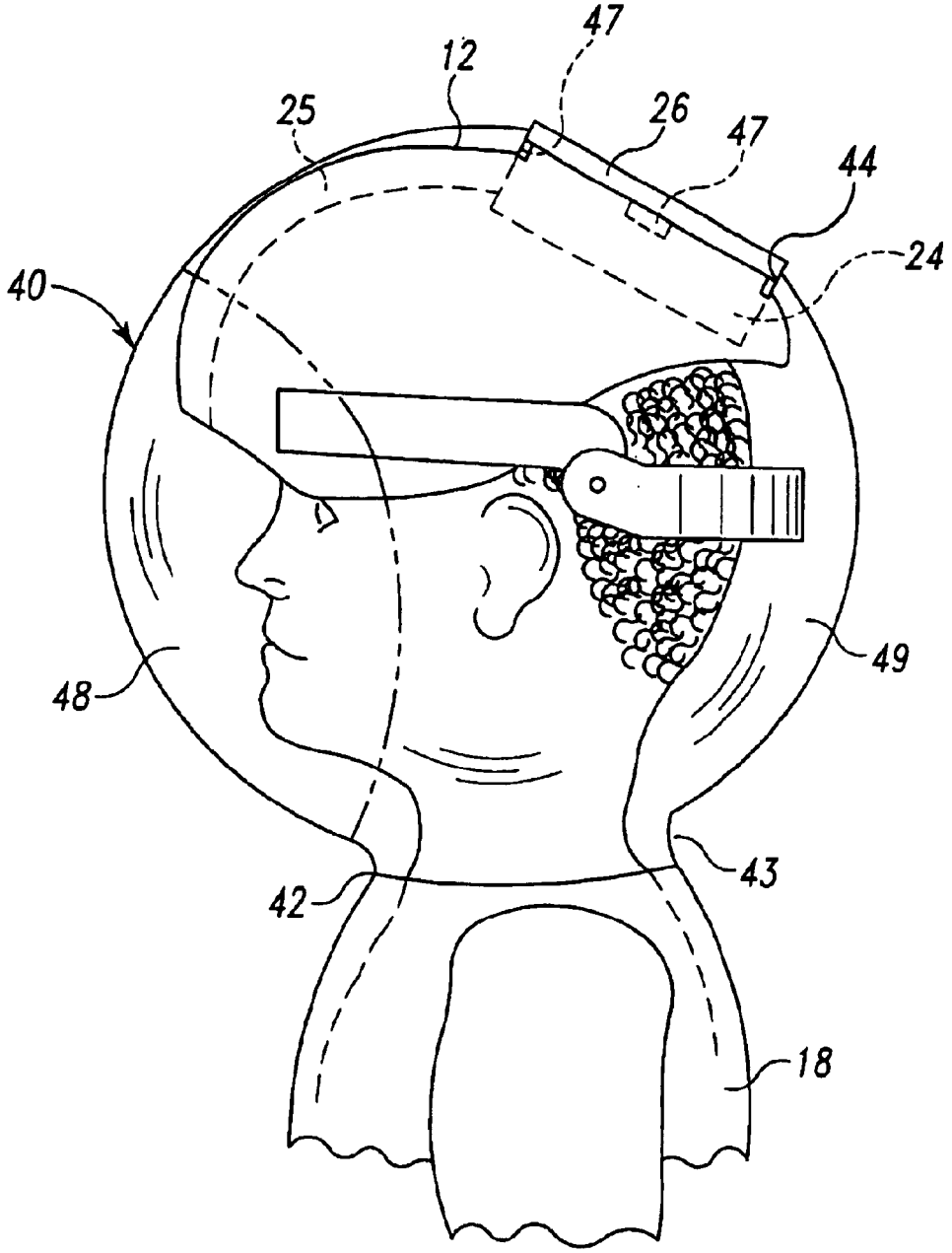
FIG. 3 is a side view of a head covering in accordance with one embodiment of the present invention, and shown in use with the ventilation system and garments shown in FIGS. 1 and 2.

Referring now to FIG. 3, it can be seen that the piezo fan of the present invention is particularly suited for use with an inflatable hood 40 that is sized to surround the head of the wearer and to provided an ample airspace around the wearer. The hood 40 can be attached to a gown 18 at a seam 42 in a conventional manner. The inflatable hood 40 is defined by a film 41 (FIG. 5) formed of an elastic, optically clear material so that the hood takes on the form of a transparent bubble when inflated. The film material is most preferably substantially air impermeable. The film material can be a cellulosic plastic or a silicone resin, for example. The hood 40 can be produced in a manner similar to the production of inflatable balloons.

The main portion of the hood is spherical and merges into a neck portion 43. The neck portion is preferably attached to the gown 18 to form an air-tight seal between the hood 40 and gown 18 so that air flow from the hood must be through the gown. This attachment can be in a variety of conventional manners. For instance, a bead of hood material can be formed around the perimeter of the neck portion 43. This bead of material can either be sewn to the gown 18 or can be elastically retained within an upper portion of the gown.

Most preferably, an airtight seal is formed at the seam 42 between the inflatable hood 40 and the gown 18. This airtight seal will help maintain an above-atmospheric air pressure within the interior of the inflatable hood 40 when the ventilation system is operating. Preferably, the film 41 of the inflatable hood 40 is formed of a material that is sufficiently elastic to assume an undeformed shape to facilitate storage. When the hood is placed over the wearer and the ventilation system is activated, the air pressure within the hood airspace increases to inflate the hood to the generally spherical shape shown in FIG. 3. The reduce area of the neck portion 43, together with the airtight seal to the gown 18, helps maintain the pressure within the hood.

Figure 4:
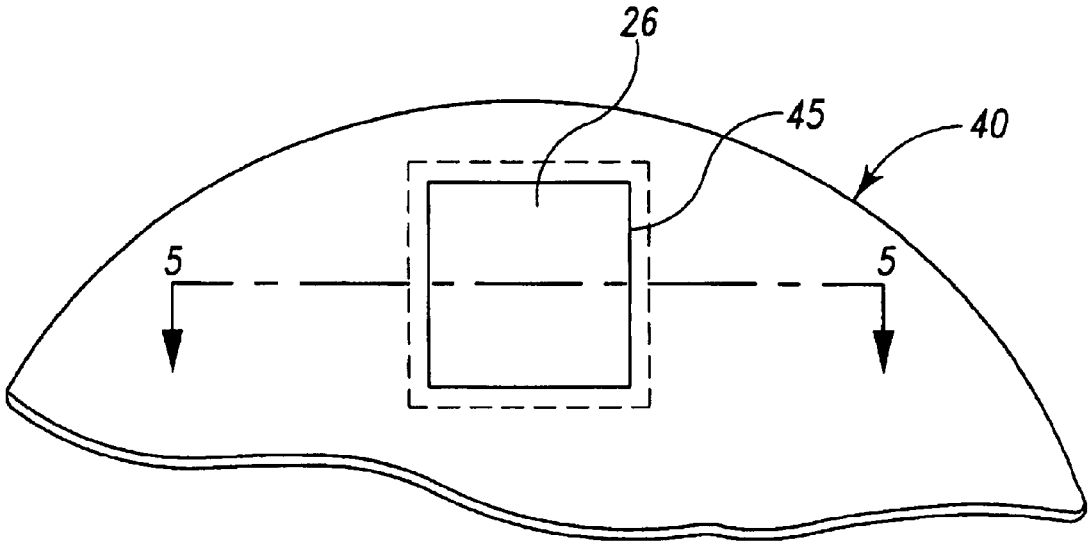
FIG. 4 is a top elevational view of the head covering shown in FIG. 3 particularly focusing on a filter element within the covering.
Figure 5:
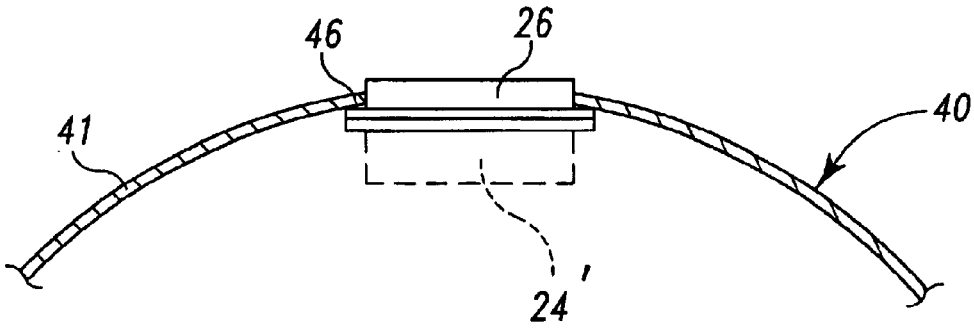
FIG. 5 is a side cross-sectional view of the head covering shown in FIG. 4 taken along line 5—5 as viewed in the direction of the arrows.

As illustrated in FIG. 3, the inflatable hood 40 is configured to integrate with an air-moving system, such as the ventilation helmet 12 shown in detail of FIG. 2. In the preferred embodiment, the inflatable hood 40 includes an air permeable opening 44 that preferably includes a filter element 26 mounted therein. As best shown in FIGS. 4 and 5, the filter element can be attached to the hood material by way of a filter seal 45. In a preferred embodiment, this seal constitutes a perimetrical flange 46 (FIG. 5) around the perimeter of the filter 26. The hood material can then be sealingly attached to the flange 46, such as by heat sealing or adhesive attachment. Again, a leak-proof seal is important to help maintain the air pressure within the inflatable hood 40. The filter 26 can be formed of any conventional material used for filtration of personal ventilation systems. Most preferably the filter 26 is formed of a lightweight material so that the hood 40 can adequately support the filter when it is inflated.

Naturally, the filter 26 is most appropriately positioned directly adjacent the inlet to the fan assembly 24. In one embodiment, the filter 26 is positioned on the hood 40 so that it becomes aligned with the fan assembly 26 when the helmet 12 and hood 40 are being worn by the person. In this instance, the fan will naturally draw air through the filter, although it might be anticipated that there may be some recirculation of the air within the interior of the hood.

In a preferred embodiment, means 46 are provided for connecting the filter 26 to the fan assembly 24. This means for connection 46 can be modified depending upon the nature of the filter 26 and the fan assembly 24. In a specific embodiment, the means for connection 47 can include a number of latches or hooks projecting from the flange 46. These hooks can engage corresponding notches (not shown) within the fan assembly 24. Alternatively, the means for connection 47 can be associated with the fan assembly 24, again assuming a variety of configurations, that all are arranged to connect the filter 26 to the fan assembly 24.

In an alternative embodiment, a fan assembly 24' can be mounted directly to the flange 46 so that the fan assembly 24' can be supported by the inflatable hood 40 along with the filter 26. With this embodiment, the fan assembly 24' would necessarily be formed of a lightweight material so that it will not cause the hood 40 to deflate or to deflect significantly at the point of attachment. However, if the fan assembly 24' is sufficiently light and if the air pressure within hood 40 is sufficiently great, the hood will be capable of supporting the fan.

As indicated above, the hood assembly 40 is preferably formed entirely of an optically clear or transparent material. Alternatively, only a portion of the inflatable hood 40 need be optically clear. For instance, a viewing area 48 can be clear or transparent, while the remainder 49 of the hood can be translucent or even opaque. The viewing area 48 can be made sufficiently large so that wearer has a full unobstructed view from within the hood 40. In embodiments where the hood 40 is not attached directly to a headpiece or helmet, such as helmet 12, the person wearing the hood may rotate his/her head within the hood. In this instance, the viewing area 48 must be sufficiently large to account for the normal range of head rotation from side-to-side.

The remaining portion 49 of the hood 40 can have adjusted optical properties to, for instance, reduce glare or stray light passing into the hood. In addition, if the inflatable hood 40 is used on a protective garment outside the surgical area, different opacities may be desirable. For example, if the garment is to be used outdoors, a reflective coating in the portion 49 may be desirable to help reduce heat buildup within the inflatable hood 40 due to incident sunlight.

In yet another alternative, the viewing area 48 can be formed of the elastic optically clear material discussed above, while the remaining portion 49 can be formed of a different material. However, it is important that the material of the remaining portion 49 be generally air-tight in order to maintain the air pressure within the hood 40. Maintaining the air pressure will maintain the expanded shape of the viewing area 48 so that the wearer will have an undistorted view. The portion 49 can even be formed of a rigid material, such as a rigid plastic. While a rigid portion 49 will not balloon, the viewing area 48 will retain its elastic properties so that the area 48 becomes inflated under pressure within the hood.

Figure 6:
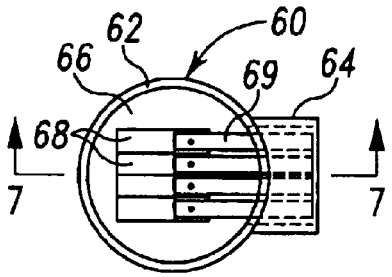
FIG. 6 a top elevational view of a piezo fan assembly in accordance with one embodiment of the present invention.
Figure 7:
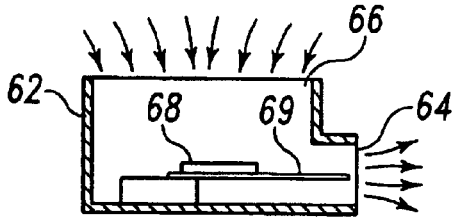
FIG. 7 a side cross-sectional view of the piezo fan assembly shown in FIG. 6, taken along a line 7—7 and viewed in the direction of the arrows.

In accordance with the present invention, the protective garment and specifically the air-moving system described above can be modified to utilize a piezo fan component. Specifically, the air-moving system includes a piezo fan assembly 60, as shown in FIG. 6, can be substituted for the fan 24 illustrated in FIG. 2 or the fan 24' shown in FIG. 5. The piezo fan assembly 60 includes a housing 62 that can be adapted to be mounted on the ventilation helmet 12. The housing defines an outlet duct 64 for discharge air flow. The housing 62 further defines an inlet 66, which in the case of the illustrated embodiment encompasses substantially the entire top portion of the housing 66, as shown in FIG. 7.

Figure 10:
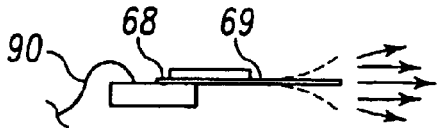
FIG. 10 is a side detail view of a piezo fan component used with the piezo fan assemblies shown in FIGS. 6–9.

In accordance with the present invention, the fan assembly 60 includes a number of piezo components 68, each supporting an oscillating blade 69. The piezo components 68 preferably rely upon electrical resonance characteristics to induce vibration in the cantilever blades 69. The motion of the blades 69 is depicted in FIG. 10. As the blade 69 vibrates, it generates a forward air flow extending from the tip of the blade. The piezo components 68 can be of known design. For instance, in a specific embodiment, a piezo fan blade part no. RFN1-005, produced by Piezo Systems, Inc. of Cambridge, Mass., can be utilized in the piezo fan assembly 60 of the present invention. This particular piezo component is advertised as generating a volume flow rate of 2 cfm with a peak air velocity of 400 fpm. Of course, other piezo fan or vibratory components can be implemented provided they can generate appropriate air flow and pressure. In the embodiment shown in FIGS. 6 and 7, air is drawn in through the inlet opening 66 at the top of the housing 62. Vibration of the piezo blade 69 generates an outlet air flow through the outlet duct 64. In this embodiment, the outlet air flow is generally perpendicular to the inlet air flow through the opening 66.

The piezo component 68 can be used in a variety of fan configurations. For instance, referring to FIG. 8, a multiple outlet fan 75 is provided. In this embodiment, a single inlet opening 77 provides air to be discharged through multiple outlet ducts 80–83. In this embodiment, the outlet flow path is generally perpendicular to the inlet flow path provided by opening 77. Moreover, each of the outlet flow paths generally originate beneath the opening 77. Each of the outlet ducts 80–83 includes an associated number of piezo components 68 and corresponding reciprocating blades 69. In the preferred embodiment, the inlet side 70 of each piezo component, or more specifically each blade 69, is directly exposed to the inlet opening 77 to maximize the transition of inlet air to discharge.

Figure 8:
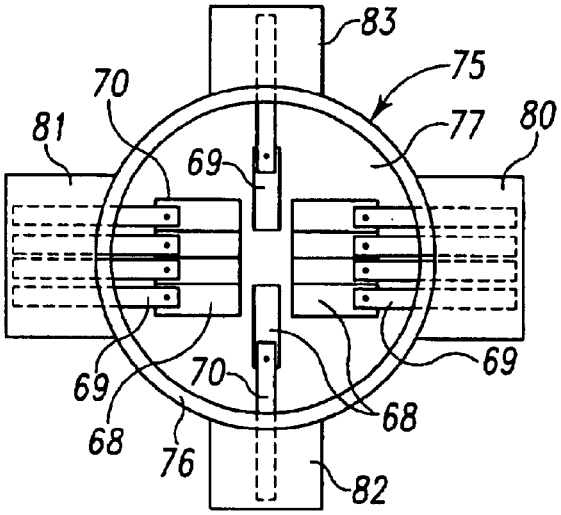
FIG. 8 is a top elevational view of an alternative embodiment of a piezo fan assembly in accordance with the present invention.

In accordance with the present invention, the number of piezo components 68 dictates the air flow directed through the corresponding outlet duct 80–83 (assuming that each of the piezo components is substantially identical). Thus, as illustrated in FIG. 8 the outlet ducts 80 and 81 include four piezo components 68 aligned with the ducts. On the other hand, the two ducts 82 and 83 have but a single piezo component 68 directing air flow through that duct. Thus, the multiple fan assembly 75 can produce directed air flow rates at selected locations. Of course, any one of the outlet ducts 80 can be closed or more specifically the piezo component associated with that duct removed. Likewise, the ducts can be arranged relative to each other in a variety of orientations. As shown in FIG. 8, each of the ducts is oriented at 90° intervals. If a different discharge air flow pattern is desired, the ducts can be moved around the perimeter of the housing 76 of the multiple fan assembly 75.

A comparison of the fan assembly 60 shown in FIG. 6 and the fan assembly 75 in FIG. 8 also reveals the capability of the present invention to adapt to different sizes. Specifically, the inlet opening 66 for the fan assembly 60 is smaller than the inlet opening 77 for multiple fan assembly 75 shown in FIG. 8. The larger opening in the fan assembly 75 allows for greater quantities of air to be drawn into the fan assembly to thereby feed each of the piezo components at the four outlet ducts. On the other hand, since the fan assembly 60 includes but a single array of piezo components and a single outlet, a smaller inlet opening 66 can be acceptable to achieve a similar air flow exiting that duct.

Figure 9:
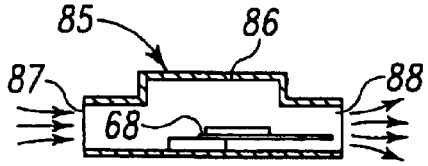
FIG. 9 is a side cross-sectional view of a piezo fan assembly according to an additional embodiment of the invention.

In yet another embodiment of the invention, a fan assembly 85, as shown in FIG. 9, can include a housing 86 that is closed at its top instead of having the large inlet opening 66 at the top of the housing, as with the previous embodiments. The fan assembly 85 utilizes an inlet duct 87 to supply air to the piezo element 68 within the housing. An outlet duct 88 is also defined by the housing 86 for the air flow generated by the piezo element. It is understood that a similar configuration can be implemented with the multiple fan assembly 75. Specifically, the top opening 77 of the housing 76 can be closed and one of the outlet ducts 80–83 can be modified to function as an air inlet to the fan assembly.

Figure 11:
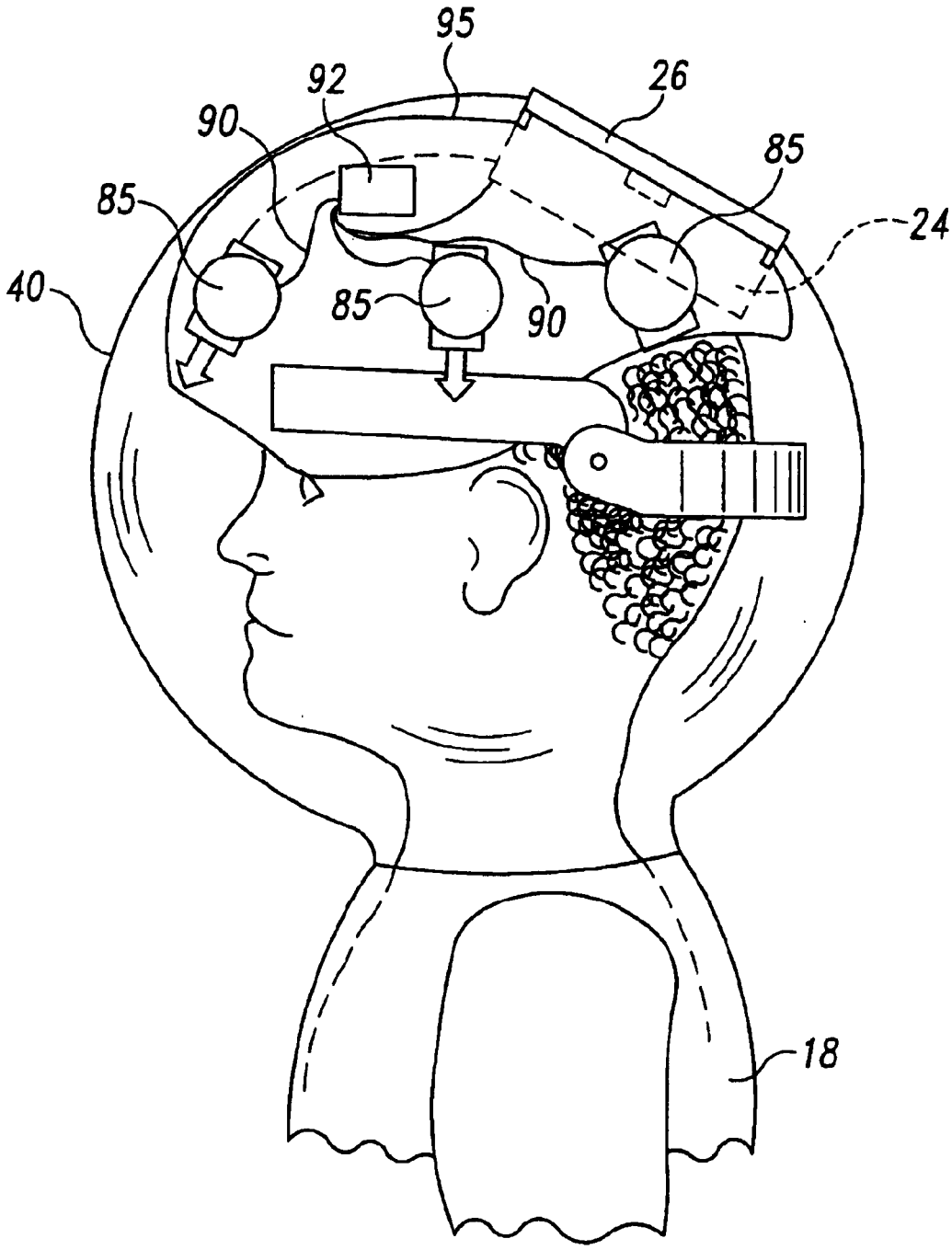
FIG. 11 is a side view of a protective garment and hood arrangement with a number of piezo fan assemblies associated therewith in accordance with one aspect of the present invention.

The present invention contemplates using one or more of the piezo fan assemblies described above in conjunction with a ventilated protective garment. In a specific embodiment, the garment includes a hood, such as the hood 40 described above. The wearer of the garment can also wear a ventilation helmet 12. The helmet can be provided with a number of piezo fan assemblies, such as the fan assembly 85 shown in FIG. 9. As illustrated in FIG. 11, the fan assemblies can be disbursed to various locations on the helmet 95. The piezo fan assemblies 85 can augment the rotary fan 24 described in connection with FIG. 2 above. Alternatively, and most preferably, the fan 24 can be replace with a piezo fan assembly, such as the assembly 60 shown in FIG. 6.

It is understood that each of the piezo fan assemblies 85 can be replaced with any of the other fan assemblies 60 or 75 described above with appropriate modifications to the housing and inlets based upon the location and use of the fan. However, it can be appreciated that the piezo fan assemblies of the present invention allow for directed air flow throughout the protective garment. Thus, the piezo elements can be readily mounted to the helmet worn by the medical personnel. Alternatively, the element can be fixed to the hood 40 at various locations around the surface of the hood, in the manner of the fan 24' illustrated in phantom in FIG. 5. Likewise, the same piezo fan assemblies can be situated at the base of the hood or at the neck portion of the gown 18 to help direct exhaust air flow out of the garment.

One significant benefit of the piezo fan assembly of the present invention is that it is very lightweight. In the specific illustrated embodiment of the part number RFN1-500 piezo fan, its weight is less than 3.0 grams. Thus, many of these piezo fan assemblies can situated even on the helmets worn by the medical personnel without any significant increase of overall weight of the protective garment.

In the preferred embodiment of the invention, the piezo components 68 are electrically activated. Thus, each components includes an electrical input 90 (FIGS. 10 and 11) that connects each piezo component to a power supply, such as the supply 92 shown in FIG. 11. Depending upon the particular piezo components, the power supply may be simply a battery, or may require connection to an external electrical power source. The power supply 92 in the illustrated embodiment can be the actual power source (such as a battery), or can be a junction box for connection to a power source apart from the supply 92. For instance, if a large battery pack is required to energize a large number of piezo fan components, the battery pack may be supported on the torso of the wearer. In that case, the power supply 92 would include an electrical connection from the power supply 92 to the torso-carried power source The piezo fan component 68 presents a wide range of flexibility in its use in connection with protective and ventilated garments. Each piezo component is lightweight enough to be easily mounted directly within the head covering itself, so that in some instances a ventilation helmet, such as the helmets 12 or 95 can be eliminated the piezo fan components 68 also present other significant advantages. For instance, there are no mechanically moving parts associated with the components that might wear out or require replacement. Moreover, this lack of moving parts means that heat generation and build-up within the hood is not a problem. A second significant benefit enjoyed by a helmet-mounted piezo fan of the present invention is that the piezo elements are very quiet in comparison to the rotary fan assemblies used in prior devices. Thus, the piezo fan components need not be isolated from the ears of the wearer to avoid affecting the hearing of the wearer.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A ventilated garment comprising:

a head cover defining an airspace for receiving the head of a wearer therein;

an air-moving system including a piezo fan assembly including at least one piezo element having an oscillating blade operable to generate airflow; and means for supporting said piezo fan assembly within said airspace, wherein said means for supporting said piezo fan assembly includes at least one piezo element carried by said head cover, wherein said piezo fan assembly includes a plurality of piezo elements, and wherein said piezo fan assembly includes a first number of said plurality of piezo elements oriented to generate airflow in a first direction and a second number of said plurality of piezo elements oriented to generate airflow in a second direction different from said first direction.

2. The ventilated garment according to claim 1, wherein said means for supporting includes a helmet to be worn on the head of the wearer.

3. The ventilated garment according to claim 1, wherein said piezo fan assembly includes a common housing supporting each of said plurality of piezo elements.

4. The ventilated garment according to claims 1, wherein said first number is different from said second number.

5. The ventilated garment according to claim 1, wherein said piezo fan assembly includes a power supply.

6. The ventilated garment according to claim 5, wherein said power supply includes a battery carried by said means for supporting.

7. A ventilated garment comprising:

a head cover defining an airspace for receiving the head of a wearer therein;

an air-moving system including a piezo fan assembly including at least one piezo element having an oscillating blade operable to generate airflow; and means for supporting said piezo fan assembly within said airspace, wherein said piezo fan assembly includes a housing defining an inlet opening and a number of outlet ducts, wherein said at least one piezo element is mounted within said housing between said inlet opening and said number of outlet ducts, and wherein at least some of a number of piezo elements are disposed within a corresponding one of said number of outlet ducts.

8. The ventilated garment according to claim 7, wherein said inlet opening is arranged relative to said number of outlet ducts so that airflow into said inlet opening is substantially perpendicular to airflow discharged from said number of outlet ducts.

9. The ventilated garment according to claim 7, wherein:

each of said number of piezo elements includes an inlet end; and at least some of said piezo elements are mounted within said housing so that said inlet end is substantially aligned with said inlet opening.

10. A ventilated garment comprising:

a head cover defining an airspace for receiving the head of a wearer therein;

an air-moving system positioned within said airspace and including a piezo fan assembly including at least one piezo element having an oscillating blade operable to generate airflow, wherein said piezo fan assembly includes a plurality of piezo elements, wherein said piezo fan assembly includes a first number of said plurality of piezo elements oriented to generate airflow in a first direction and a second number of said plurality of piezo elements oriented to generate airflow in a second direction different from said first direction.

11. The ventilated garment according to claim 10, wherein said piezo fan assembly includes a common housing supporting each of said plurality of piezo elements.

12. The ventilated garment according to claim 10, wherein said f first number is different from said second number.

13. The ventilated garment according to claim 10, wherein said piezo fan assembly includes a power supply.

14. The ventilated garment according to claim 13, wherein said power supply includes a battery.

15. The ventilated garment according to claim 10, wherein said air-moving system includes a plurality of piezo fan assemblies supported on said head cover.

16. A ventilated garment comprising:

a head cover defining an airspace for receiving the head of a wearer therein; and an air-moving system positioned within said airspace and including a piezo fan assembly including a number of piezo elements each having an oscillating blade operable to generate airflow, wherein said piezo fan assembly includes a housing defining an inlet opening and a number of outlet ducts, wherein said number of piezo elements are mounted within said housing between said inlet opening and said number of outlet ducts, and wherein at least some of said number of piezo elements are disposed within a corresponding one of said number of outlet ducts.

17. The ventilated garment according to claim 16, wherein said inlet opening is arranged relative to said number of outlet ducts so that airflow into said inlet opening is substantially perpendicular to airflow discharged from said number of outlet ducts.

18. The ventilated garment according to claim 16, wherein:

each of said number of piezo elements includes an inlet end; and at least some of said piezo elements are mounted within said housing so that said inlet end is substantially aligned with said inlet opening.

* * * * *